US006516754B2

(12) United States Patent
Chadwick

(10) Patent No.: US 6,516,754 B2
(45) Date of Patent: Feb. 11, 2003

(54) CONVECTIVE HEATING SYSTEM FOR LIQUID STORAGE TANK

(76) Inventor: Thomas Chadwick, Box 204, Halkirk, Alberta, T0C 1M0 (CA)

( * ) Notice: Subject to any disclaimer, the term of this patent is extended or adjusted under 35 U.S.C. 154(b) by 16 days.

(21) Appl. No.: 09/785,332

(22) Filed: Feb. 20, 2001

(65) Prior Publication Data

US 2002/0112677 A1 Aug. 22, 2002

(51) Int. Cl.[7] ..... F22B 1/02

(52) U.S. Cl. ..... 122/19.1; 122/32; 122/505; 137/264; 220/560.1

(58) Field of Search ..... 122/13.01, 15.1, 122/18.5, 19.1, 32, 233, 234, 505, 489; 137/264, 409, 429, 375, 337, 340, 391; 220/560.1

(56) References Cited

U.S. PATENT DOCUMENTS 4,158,384 A 6/1979 Brautigam
4,248,177 A 2/1981 Peterson et al.
4,704,991 A 11/1987 Moore
5,006,689 A * 4/1991 Kurachi et al. ..... 122/494
5,020,721 A * 6/1991 Horne ..... 126/362
5,251,473 A * 10/1993 Reese ..... 137/264
5,850,503 A 12/1998 Onken
5,908,008 A 6/1999 Sensabaugh
5,960,826 A 10/1999 Hebblethwaite et al.
5,971,009 A 10/1999 Schuetz et al.

* cited by examiner

*Primary Examiner*—Gregory Wilson

(57) ABSTRACT

A heating system for heating liquids, stored in a tank at low ambient temperature, has a heating chamber with an inlet and an outlet for convectively flowing liquid past a flameless heater. Cold liquid is drawn through an inlet line, from the tank near its base and into a heating chamber, absorbs radiant energy from the heater as it travels therethrough. Heated liquid is circulated into the tank through an upper outlet from the heating chamber and back into the tank. Preferably, the heated liquid reenters the tank through a floating discharge flexibly connected to the upper outlet so as to remain dynamically in contact with the liquid at all times, thus avoiding airlocks which would interrupt the convective flow of liquid through the heating system.

11 Claims, 6 Drawing Sheets

CONVECTIVE HEATING SYSTEM FOR LIQUID STORAGE TANK

FIELD OF THE INVENTION

The present invention relates to tanks for storing liquids and more particularly to tanks for storing liquids which can freeze at low ambient temperatures.

BACKGROUND OF THE INVENTION

It is well known to store large quantities of liquids in both aboveground and underground tanks, especially liquids produced from such industries as the oil and gas industry, where liquids such as water contaminated with oil, must be stored on site before removal and cleanup. Liquid storage is also required in a number of different industries and applications.

Aboveground tanks are often preferable to underground tanks as there is no need to excavate a site and leakage detection is more easily performed. Regulations governing environmental protection, hazardous materials handling and worker safety provide structured guidelines with which such storage tanks can be constructed, whether single-walled or double-walled.

As taught in U.S. Pat. No. 5,971,009 to Schuetz et al., the use of aboveground tanks in climates subject to extreme ambient temperatures has not found favor in the industry, due to problems such as freezing or increased viscosity of tank contents. Schuetz et al. addressed the freezing problem by providing a support means upon which the tank was placed, so as to create an air space under the tank. The entire structure and the air space is isolated from ambient using a layer of insulation. Further, a heater is used to heat the air space below the tank to keep the tank's contents from freezing, rather than heat the content's of the tank directly, which was deemed to be expensive and impractical. Heat can also be directed into the annular space formed between the inner and outer walls.

The above prior art is in the form of a custom constructed tank. Construction of such aboveground tanks requires a significant amount of cost and man-hours. In times of increased activity in industries such as the drilling and production sector of the petroleum industry, it may be difficult to supply the large number of tanks required to satisfy needs. Any additional complex construction for integrating tanks, support means and heaters into complete, heated-tank systems increases the amount of time and money required to produce tanks. Further, advance construction and stockpiling of tanks is often not a practical solution, as it is difficult to predict their use in many industries which have fluctuating needs, resulting in a large amount of revenue being tied up and unrecoverable until the tanks are sold.

Further, most well sites do not have ready access to electrical power, if any, and therefore it is known to utilize equipment capable of being run using well products such as raw natural gas.

Ideally, a heating system for a liquid storage tank, whether part of the original design of a tank system or as a retrofit to an existing tank system, should be relatively inexpensive to build and to operate, provide adequate heat to the tanks contents to prevent freezing, require no electricity, be easily accessible from the exterior of the tank system for servicing and preventative maintenance, utilize simplified construction and be easily added to existing tank systems.

SUMMARY OF THE INVENTION

The present invention provides a heating system that is simple to construct and is readily retrofit to existing tank systems. The heating system satisfies the requirements of being readily accessible for service and maintenance, and does not require electrical power to operate.

In a broad aspect of the invention, a tank heater system is provided comprising a hollow heating chamber having a lower inlet, in communication with an inlet line extending into and adjacent the bottom of the tank, and an upper outlet, in communication with the liquid in the tank. A heater is positioned for heating the heating chamber. Liquid, drawn from the tank into the inlet line, is heated in the heating chamber where it rises by convection and is reintroduced to the tank through the outlet.

Preferably, the heating chamber has a plurality of baffles inside the hollow chamber for increasing the residence time of the liquid in the heating chamber and increasing the fluid's heat capacity. A flameless, infrared gas catalytic-type heater can be used to avoid the need for electricity and comply with explosion proof conditions. Further, the discharge to the tank is in constant communication with the liquid in the tank, including the use of a floating discharge which remains in constant communication with the liquid in the tank and thus preventing airlock when the liquid level drops below that of the upper outlet's connection to the tank. Enclosing the heating system against the tank wall, scavenges residual heat and applies it to the tank. In yet another embodiment of the invention, a gas powered or heat powered pump is fitted into heating chamber system, thereby creating forced convection to ensure liquid flow is maintained.

DETAILED DESCRIPTION OF THE PREFERRED EMBODIMENT

Natural gas produced at a wellhead typically carries heavier liquids, primarily water, which is separated from the gas flow. The hydrocarbon-tainted water is then directed to a storage tank where it is contained until removal and subsequent treatment. Often wells of this type are located in climates subject to very low ambient temperatures for at least part of the year.

Figure 1A:
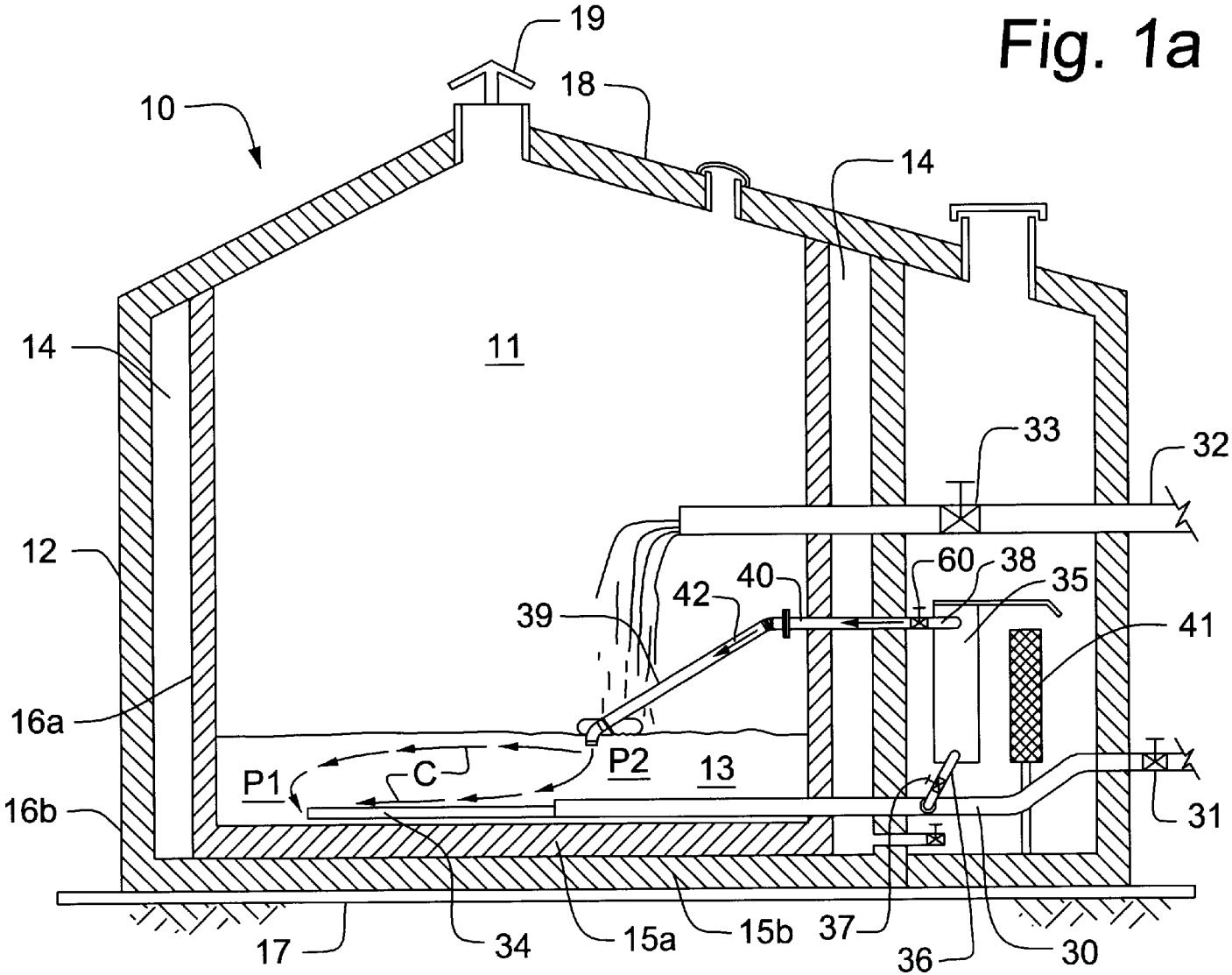
FIG. 1*a* is an elevation view in cross-section of a dual walled tank having a heater system of the present invention wherein the load line and the inlet line are separate lines and the inner and outer tanks have a shared roof.

Having reference to FIG. 1*a*, and in one embodiment of the invention, a storage tank 10, which may be dual-walled, and a heating system of the present invention is shown. It is understood that a storage tank 10 may be a single wall or a dual-wall tank without affecting the functionality of the heating system. This specification discloses the present invention as applied to a dual-walled tank. Dual-walled tanks are well known in the industry.

An inner tank 11 sits within and is surrounded by a larger outer tank 12. The outer tank 12 is of sufficient volume to contain any and all liquid 13, which may leak from the inner tank 11, within the annular airspace 14 created between the two tanks 11,12. Both tanks 11,12 have a substantially planar circular base 15*a*, 15*b* joined with an upstanding continuous cylindrically shaped side wall 16*a*, 16*b*. The base 15*a* of the inner tank 11 rests directly upon the base 15*b* of the outer tank 12, the tanks 11,12 resting directly on a metal plate 17 located on a base or upon prepared level soil or gravel. The inner tank 11 has a conical roof 18 that is supported on and connected to the side wall 16*a*. Further, the roof 18 has a vapour exhaust or vent 19, which access the inner tank 11 to relieve excessive pressure build-up in the inner tank 11.

Figure 1B:
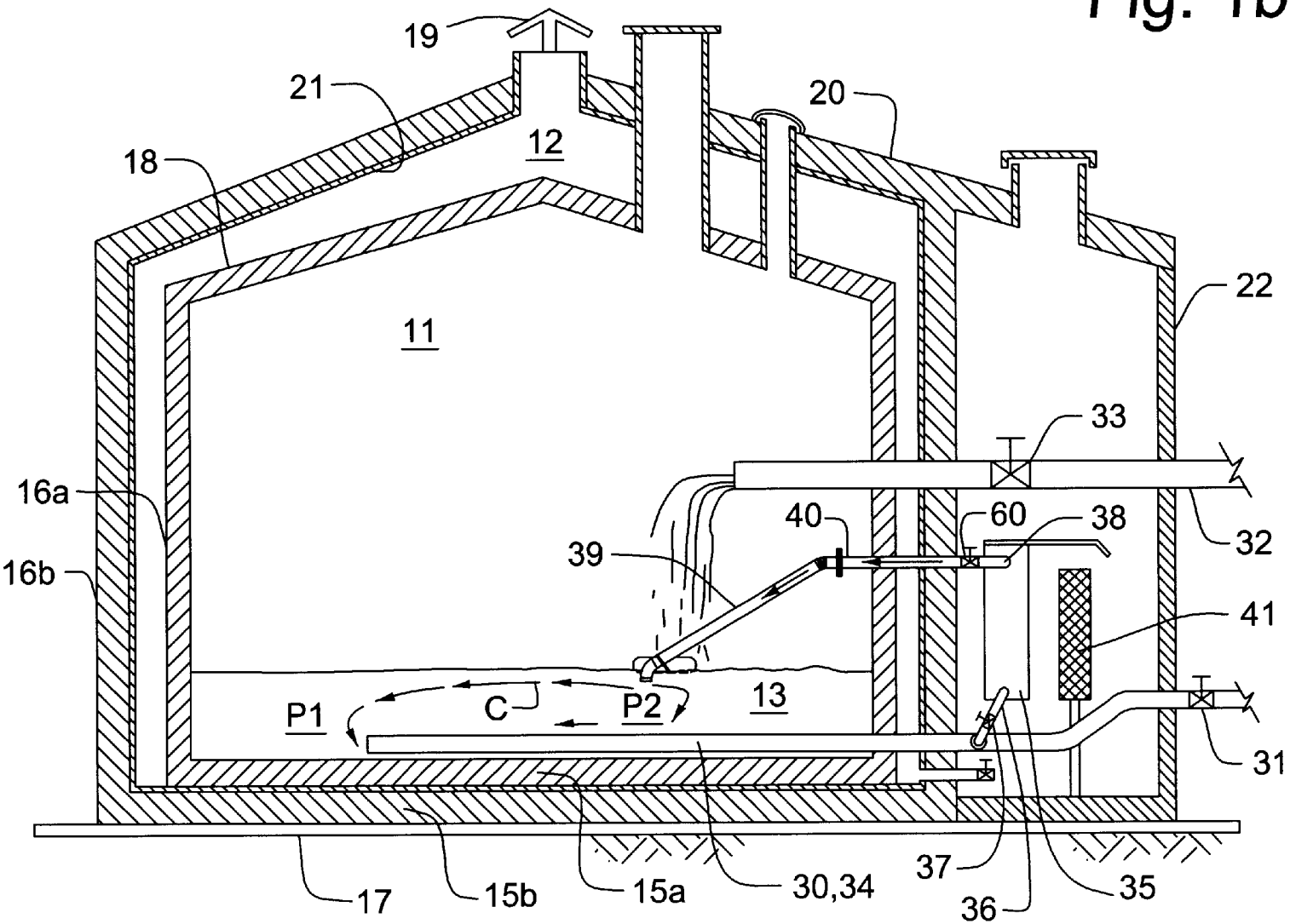
FIG. 1*b* is a partial elevation view in cross-section of a dual walled tank having a heater system of the present invention wherein the load line and the inlet line are the same line and the inner and outer tanks separate roofs.

The outer tank 12 may share the same roof 18 as the inner tank 11, as shown in FIG. 1*a*, or may have its own roof 20, as shown in FIG. 1*b*, the roof 20 being conical, supported on the side wall 16*b* and arched above the roof 18 of the inner tank 11. The outer tank roof 20 is also vented to prevent pressure buildup.

The outer tank 12 has a thermal insulation layer 21 covering and adhering to a surface of the side wall 16*b*, roof 20 and floor 15*b* to assist in thermally isolating the tank 12 from the ambient.

An insulated enclosure 22 is constructed adjacent the outer wall 16*b* of the outer tank 12 to house the heating system of the present invention and other such valves and equipment required to fill, empty and monitor the tank status such as detecting leaks and monitoring the temperature of the tank contents. A door (not shown) provides access to the interior of the enclosure 22 for performing maintenance and monitoring functions.

Figure 1C:
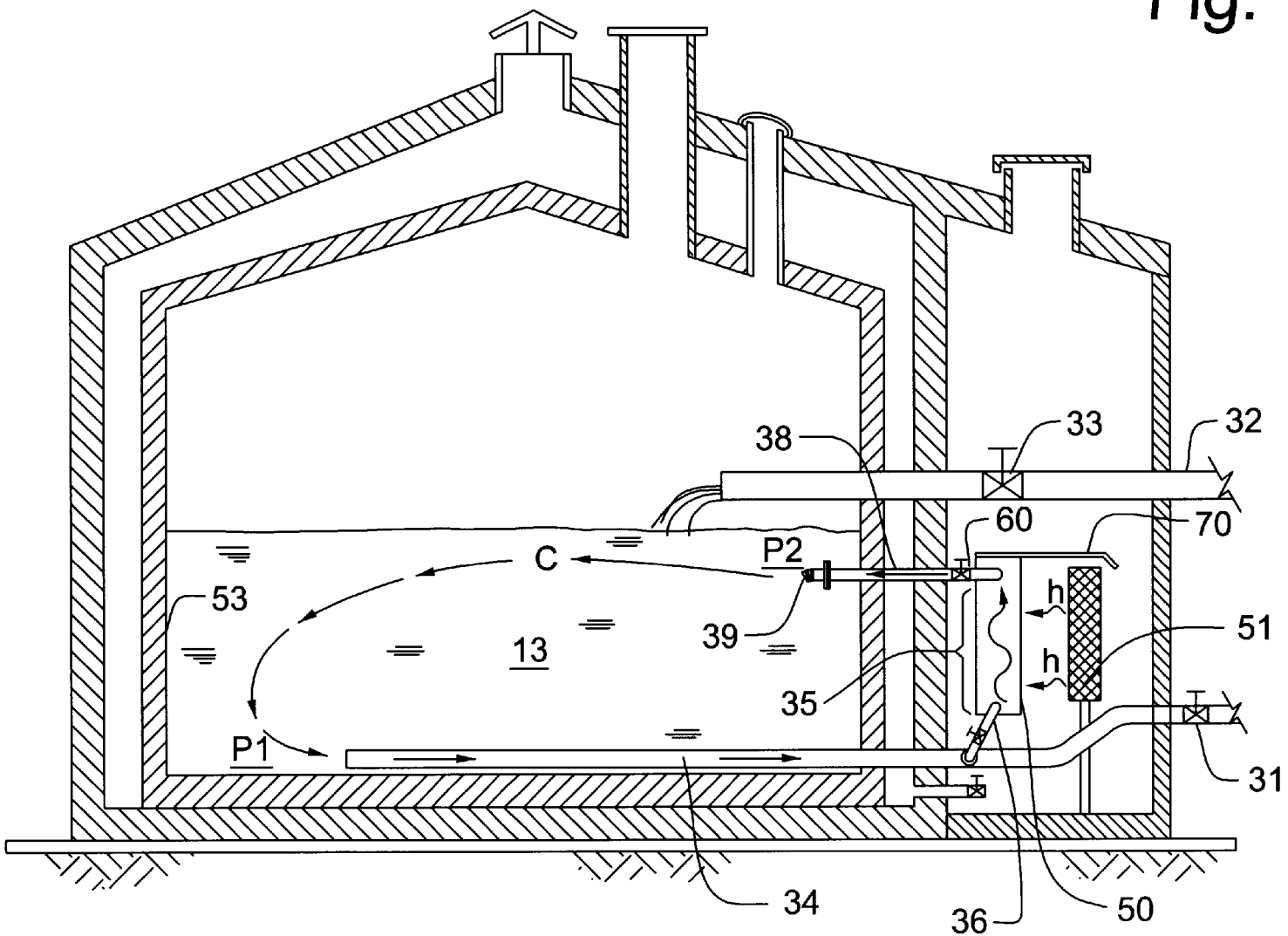
FIG. 1*c* is a partial elevation view in cross-section of a dual walled tank having a heater system of the present invention wherein the discharge extends through the side wall and into the liquid in the tank.

As shown in FIGS. 1*a*–1*c*, a load line 30 extends from within the inner tank 11, through both inner 11 and outer 12 tanks' side walls 16*a*, 16*b* in a sealing manner, at the base of the tanks 11,12, to facilitate emptying the inner tank 11. A shutoff valve 31 is located on the load line 30 to facilitate emptying the inner tank 11. A supply line 32, typically extending from a separator (not shown), is used for filling the inner tank 11 and extends through both inner 11 and outer 12 tanks' side walls 16*a*, 16*b* in a sealing manner, typically above the load line 30. A shut-off valve 33 is located on the supply line 32 to facilitate filling the inner tank 11.

An inlet line 34 is located slightly above the base of the tanks 15*a*, 15*b*, perforating both tanks' side walls 16*a*, 16*b* in a sealing manner. The inlet line 34 extends into the inner tank 11, preferably to the center of the inner tank 11 or beyond, to a first point P1, so as to access colder liquid in the tank 11. The inlet line 34 extends outwardly to a heating chamber 35. Optionally, as shown in FIG. 1 b, the load line 30 may act also as the inlet line 34.

Having reference again to FIGS. 1*a*–1*c*, the heating chamber 35 has a lower inlet 36 connected to the inlet line 34. The heating chamber 35 itself can be isolated from the inlet line 34 with a shut off valve 37 for maintenance purposes. An outlet 38 extends from the top of the heating chamber 35 and extends through the side walls 16*a*. 16*b* of both outer 12 and inner 11 tanks for reintroducing heated liquid 40 at a second point P2 in the inner tank 11. The outlet 38 has a discharge 39 located in the liquid 13 of the inner tank 11. The heater chamber 35, lower inlet 36 and upper outlet 38 form a convection circuit C of liquid 13 between the inner tank 11 and the heating chamber 35

A heat source 41, preferably a flameless catalytic gas infrared heater, is located in the enclosure 22, external to and adjacent the heating chamber 35.

So as to avoid draining of liquid 13,40 from the convection circuit c, the discharge 39 from the upper outlet 38 is positioned in the liquid 13 and located so that the discharge 39 is rarely or never out of the liquid 13 in the inner tank 11. As shown in FIG. 2*a*, one form of discharge 39 is a conduit 42 extending from the heating chamber outlet 38 to a point P3 near or below the inlet line 34.

Figure 2B:
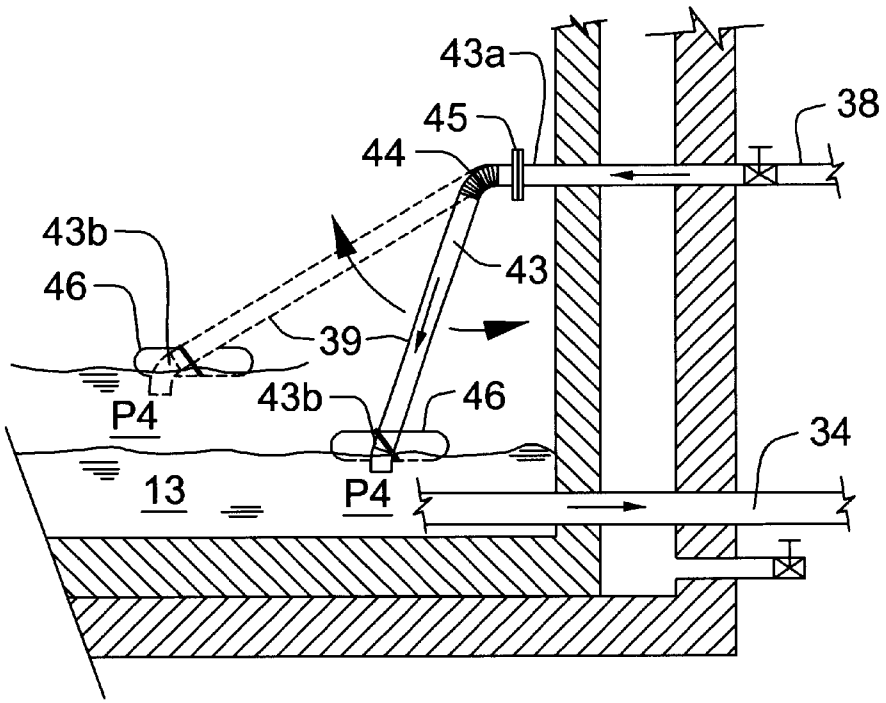
FIG. 2*b* is a partial elevation view in cross-section of the discharge from the upper outlet, wherein the discharge is a dynamic discharge.
Figure 2A:
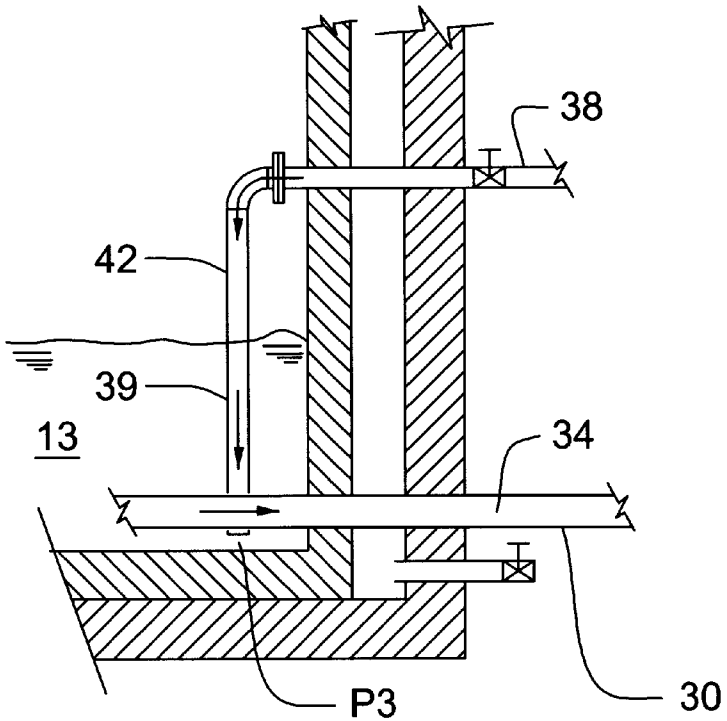
FIG. 2*a* is a partial elevation view in cross section of the discharge from the upper outlet wherein the discharge is a conduit extending to the base of the tanks.

Another form of discharge 39, as shown in FIG. 2*b*, is a dynamic discharge 43, attached to the outlet 38 as it enters the inner tank 11. The discharge 43 is attached at a first end 43*a* to the outlet 38 using a flexible connector 44 such as a piece of flexible plastic hose. The flexible connector 44 allows the discharge 43 to pivot and dynamically position a second end 43*b* immersed within the liquid 13 in the tank 11 so as to be in constant therewith, especially when the liquid 13 level in the tank 11 is below the outlet connection 45 to the tank walls 16*a*, 16*b*. Positioned thus, the discharge 43 remains at a point P4 submerged in liquid 13, preventing an air lock from occurring in the convective circuit C.

The second end of the discharge 43*b* can be fitted with a float 46 to ensure that it rises and falls with the liquid 13 level.

Optionally for tanks 10 used to store hydrocarbon-tainted water, the floating discharge 43, and outlet 38 can be used to remove any floating condensate that may have separated from the water. Separate valves (not shown) would be provided to allow removal of the condensate through the discharge 43.

Figure 3:
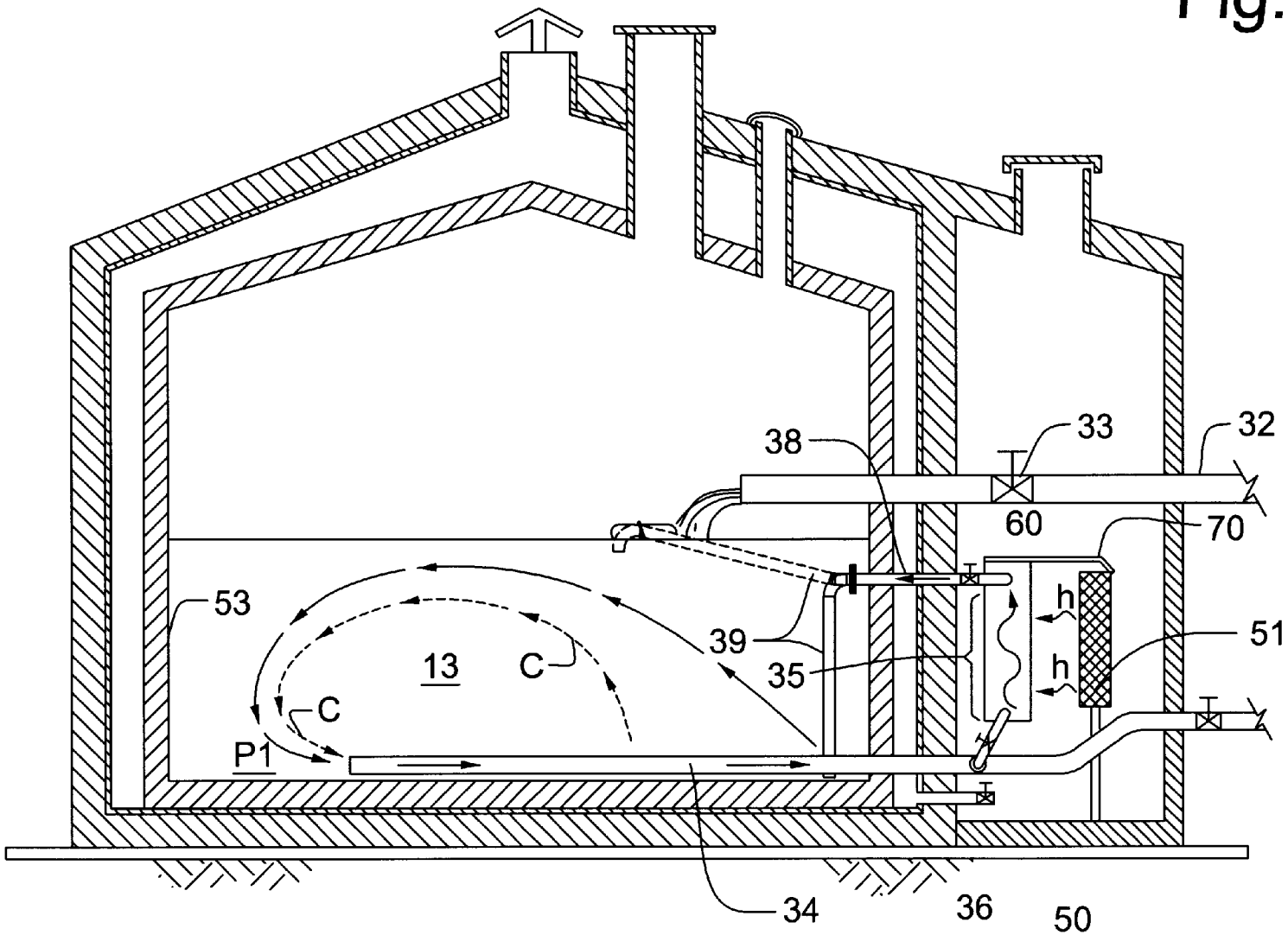
FIG. 3 is a cross-sectional view of the heater system of FIG. 1.

Having reference to FIG. 3, the heating chamber 35 comprises a vessel 50 such as a rectangular liquid-sealed box defining a hollow heating chamber 35. The heating chamber 35 is positioned directly in front of the heater 51 so as to expose a maximum amount of surface area to the radiant heat h produced by the heater 51. The lower inlet 36 from the inlet line 34 extends into the bottom of the heating chamber 35.

The upper outlet 38 extends from the top of the heating chamber 35. A plurality of outlets 38, 38 . . . can be provided for discharge into the tank; one resulting benefit being to minimize pressure drop of the convective flow.

Figure 4:
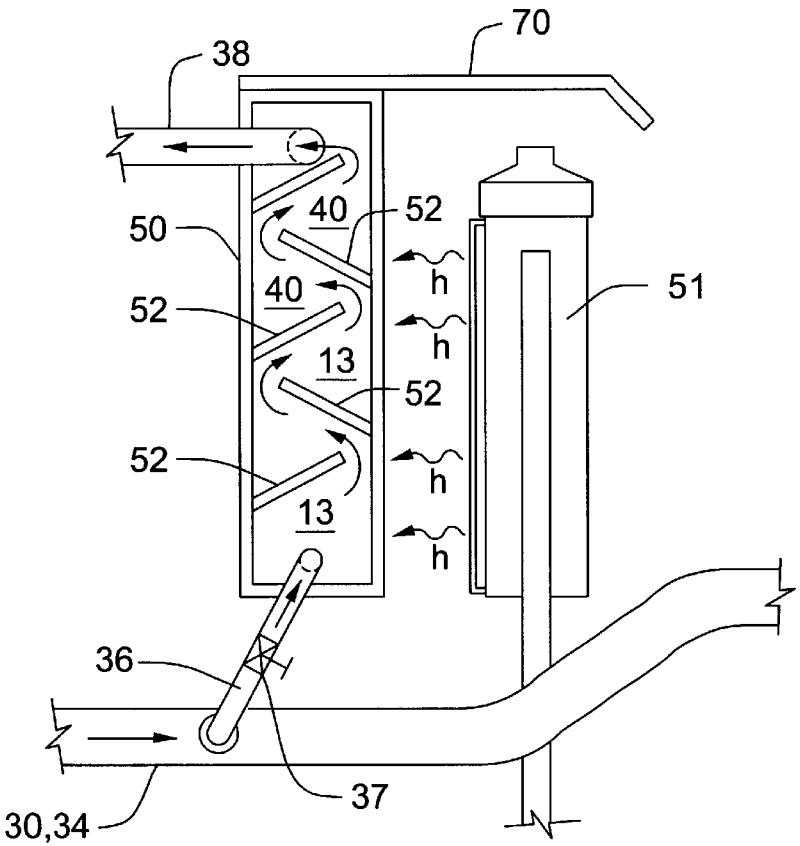
FIG. 4 is an elevation view in cross-section of the dual walled tank and heater system of FIG. 1 showing the convection currents in the liquid.

To improve the heating effect from that provided by a simple hollow heating chamber 35, a plurality of baffles 52, as shown in FIG. 4, are positioned inside the chamber 35 so as to create a serpentine pathway therethrough and thus increase the residence time of liquid 13, 40 flowing through the chamber 35.

As shown in FIG. 3, liquid 13 flows through the air-tight heating system of the present invention as a result of natural convection currents C created by the differences in densities of liquid 13 at different temperatures in the heating system.

Liquid 13 within the heating chamber 35 is heated by the heater 51, preferably by radiant heat h. As the liquid 13 in the heating chamber 35 heats, it becomes less dense and begins to rise through the serpentine pathway in the heating chamber 35. The longer the liquid 13 remains in the chamber 35, the more heat it absorbs, the hotter and less dense it becomes and the more rapidly it rises. As the heated liquid 40 reaches the outlet 38, it is flowed through the discharge 39 and reintroduced into the tank 11 where it begins cooling, releasing its heat into the cooler liquid 13 in the tank 11. As the heated liquid 40 cools, its density increases and it sinks to the base 15*a* of the tank 11 where it is drawn again into the inlet line 34 by the convection currents C to repeat the heating cycle.

The inlet line 34, positioned at the center of the tank or closer to an opposite side 53 of the tank 11 from the heater 51, draws liquid 13 from the coldest liquid 13 in the tank 11, thus creating a large temperature differential between the coldest liquid 13 and the heated liquid 40 in the heating chamber 35. The large temperature differential acts to increase the operational efficiency of the system.

In one example, liquid 13 at the center of the inner tank 11 is 40 degree F as it is drawn into the inlet line 34 and lower inlet 36 to the heating chamber 35. After passing through the heating chamber 35, exposed to a flameless heater 51 having a surface temperature of 400 degrees F. and into the outlet 38, the liquid 40 reaches a temperature of approximately 70 degrees F. when it is reintroduced to the tank 11.

A globe valve 60 is located on the outlet 38 between the heating chamber 35 and the outer tank 12 and is manually set to control the rate of flow of liquid 13, 40, and it's temperature, through the heating chamber 35 and back into the inner tank 11. Further, a temperature sensor (not shown) is positioned within the inner tank 11 to continuously monitor the liquid 13 temperature and is electrically connected to a temperature readout (not shown), in the heated enclosure 22.

Optionally, a hood 70 is connected to the top of the heating chamber 35 and extends over the heater 51 to trap escaping heat from the heating chamber 35 and improve the overall efficiency of the heating process. Further, the insulated, heated enclosure 22 may be extended to the full height of the outer tank 12 in order to concentrate any residual heat scavenged from the heater 51 against the side of the outer tank 12. This scavenged heat, although applied to only a portion of the outer tank's side wall 16*b*, acts to heat the annular airspace 14 between the inner 11 and outer 12 tank, further warming the inner 11 tanks contents 13.

Further, a well gas operated pneumatic shutoff valve with a float actuated pneumatic switch (note shown) is provided to block the supply line, should the liquid level in the tank exceed maximum capacity. This is particularly useful in the case of a shared roof where there is no overflow to the annular airspace 14 between the tanks 1,12.

Figure 5:
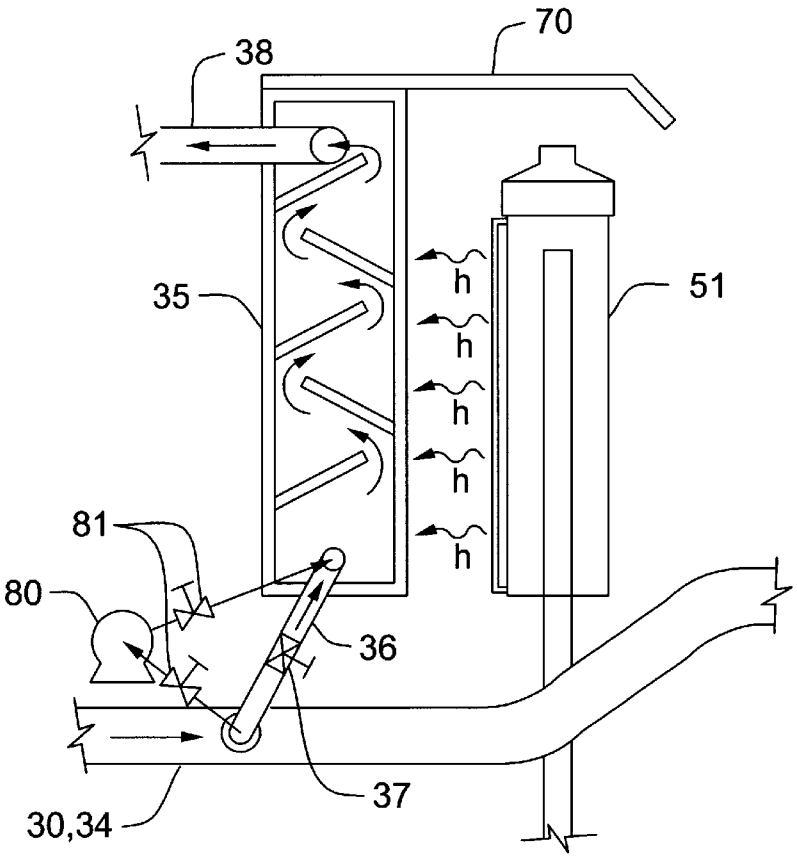
FIG. 5 is a cross-sectional view of the heater system of another embodiment having a pump for forced convection of liquids.

In another embodiment of the invention, as shown in FIG. 5, a pump 80 is added to the lower inlet 36 to the heating chamber 35 to create forced convection of the liquid 13 through the heating chamber 35. The pump 80 can be fitted to a bypass 81 for utilizing either natural or forced convention. Preferably, a gas fueled engine or a heat engine, such as a Stirling engine, is used to operate the pump 80. Heat from the flameless heater 51 is used to power the heat engine, creating a self-sufficient heating and circulation system.

For both embodiments, retrofit of an existing tank system is readily accomplished. The heating chamber 35, inlet line 34 and outlet 38 can be fit to any two ports in the liquid 13.

In cases where the load line 30 is already present, whether to the center of the tank or elsewhere adjacent the tank's bottom 15*a*, only an upper outlet 38 is required. If there is no existing port, it may be necessary to drain the inner 11 tank before perforating the side walls 16*a*, 16*b* of both inner 11 and outer 12 tank for installing the upper outlet 38. In cases where the load line 30 is inadequate for circulation, two other ports or perforations must be made to install an appropriate inlet line 34.

Typically, tanks 11,12 are fitted with two or three adjacent ports through which the inlet 36 and outlet 38 lines can be sealingly installed, for retrofit purposes.

Heating components are assembled and installed in an existing or newly constructed insulated enclosure 22 attached to the side wall 16*b* of the outer tank 12.

The embodiments of the invention for which an exclusive property or privilege is claimed are defined as follows:

1. A system for heating liquid in an aboveground liquid storage tank, at least a portion of the liquid being hydrocarbons, the heating system comprising:

a liquid heating chamber;

a flameless heat source for applying heat to the heating chamber;

a lower inlet extending between a lower portion of the tank and a lower portion the heating chamber for drawing liquid from the tank and heating the liquid in the heating chamber, the inlet being positioned so as to maximize a temperature differential between cool liquid at the inlet and the heated liquid at the outlet of the heating chamber; and an upper outlet immersed in the liquid in the tank and extending between the tank and the upper portion of the heating chamber for free convention of heated liquid through the heating chamber.

2. The convective heating system as described in claim 1 wherein the flameless heat source is a catalytic gas infrared heater.

3. The heating system as described in claim 1 further comprising an insulated enclosure adjacent to and exposed to an outer wall of the vessel.

4. The heating system as described in claim 1 wherein the discharge is flexibly connected to the upper outlet and floating in the liquid so that the discharge remains immersed in the liquid.

5. The heating system as described in claim 4 wherein the flameless heat source is a catalytic gas infrared heater.

6. The heating system as described in claim 5 further comprising an insulated enclosure adjacent to and exposed to an outer wall of the vessel.

7. A system for heating liquid in an aboveground liquid storage tank, the heating system comprising:

a liquid heating chamber;

a heat source for applying heat to the heating chamber;

a lower inlet extending between a lower portion of the tank and a lower portion the heating chamber for introducing cool liquid to the heating chamber;

an upper outlet extending between the tank and the upper portion of the heating chamber for circulating heated liquid through the heating chamber and into the tank as a result of free convection; and a discharge extending from the upper outlet, the discharge being flexibly connected to the upper outlet and floating in the liquid so that the discharge remains immersed in the liquid in the tank.

8. The heating system as described in claim 7 wherein the flameless heat source is a catalytic gas infrared heater.

9. The heating system as described in claim 8 further comprising an insulated enclosure adjacent to and exposed to an outer wall of the vessel.

10. A method of heating liquid in an aboveground liquid storage tank, the heating system comprising:

providing a convective circulation circuit of liquid between cool liquid at a first point in the tank and heated liquid at a second point, the second point being positioned above the first point and the first and second points being spaced in the tank so as to maximize a temperature differential between the first and second points;

maintaining the second point immersed in the liquid;

circulating the liquid upwardly through a heating chamber external to the tank;

heating the heating chamber for heating the liquid circulating therethrough; and discharging the heated liquid into the liquid in the tank.

11. The method of claim 8 wherein at least a portion of the liquid in the tank being hydrocarbons, the method further comprising the step of heating the heating chamber with a flameless heat source.

* * * * *